US009574732B2

(12) United States Patent
Nakada

(10) Patent No.: US 9,574,732 B2
(45) Date of Patent: Feb. 21, 2017

(54) VEHICULAR LAMP

(71) Applicant: KOITO MANUFACTURING CO., LTD., Tokyo (JP)

(72) Inventor: Yusuke Nakada, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 51 days.

(21) Appl. No.: 14/633,444

(22) Filed: Feb. 27, 2015

(65) Prior Publication Data

US 2015/0252975 A1 Sep. 10, 2015

(30) Foreign Application Priority Data

Mar. 5, 2014 (JP) ..... 2014-043226

(51) Int. Cl.
*F21S 8/10* (2006.01)
*F21W 101/10* (2006.01)
*F21Y 101/00* (2016.01)

(52) U.S. Cl.
CPC ..... *F21S 48/1275* (2013.01); *F21S 48/1154* (2013.01); *F21W 2101/10* (2013.01); *F21Y 2101/00* (2013.01)

(58) Field of Classification Search
None
See application file for complete search history.

(56) References Cited

U.S. PATENT DOCUMENTS 3,708,221 A * 1/1973 Schaefer ..... F21S 48/1258 359/718
2007/0127253 A1* 6/2007 Kawashima ..... F21S 48/1154 362/509
2008/0279541 A1* 11/2008 Montgomery ..... F21V 5/04 396/62
2009/0147529 A1* 6/2009 Ajiki ..... F21S 48/1154 362/511
2010/0046243 A1* 2/2010 Yatsuda ..... F21S 48/1154 362/538
2012/0075870 A1* 3/2012 Kayanuma ..... F21V 5/04 362/311.06
2013/0010488 A1* 1/2013 Koizumi ..... F21S 48/1154 362/517
2014/0321145 A1* 10/2014 Anzai ..... F21S 48/1317 362/516

FOREIGN PATENT DOCUMENTS

JP 4675874 B2 4/2011

* cited by examiner

*Primary Examiner* — Britt D Hanley
(74) *Attorney, Agent, or Firm* — Sughrue Mion, PLLC

(57) ABSTRACT

A vehicular lamp includes a plurality of light-emitting elements arranged such that light-emitting surfaces of the light-emitting elements face toward a front of the vehicular lamp; and a projection lens having a plurality of projection regions that face the respective light-emitting elements, and project light source images of the respective light-emitting elements facing the projection regions, to the front of the vehicular lamp. A lamp rear surface of the projection lens has protruding portions provided in the respective projection regions, the protruding portions protruding toward the respective light-emitting elements facing the protruding portions. A lamp front surface of the projection lens is flatter than the lamp rear surface.

6 Claims, 7 Drawing Sheets

VEHICULAR LAMP

INCORPORATION BY REFERENCE

The disclosure of Japanese Patent Application No. 2014-043226 filed on Mar. 5, 2014 including the specification, drawings and abstract is incorporated herein by reference in its entirety.

BACKGROUND OF THE INVENTION

1. Field of the Invention

The invention relates to a vehicular lamp, and particularly to a vehicular lamp used in a vehicle such as an automobile.

2. Description of Related Art

Japanese Patent No. 4675874 discloses a vehicular lamp that includes a plurality of light-emitting elements, and a plurality of projection lenses that correspond to the respective light-emitting elements. In the vehicular lamp, each of the projection lenses is constituted by an aspherical lens that has a protruding front surface and a flat rear surface. The projection lenses are arranged at intervals in a matrix.

In general, it is required to reduce an installation space for the vehicular lamp in the vehicle. Accordingly, it is required to reduce the size of the vehicular lamp. The inventor thoroughly studied about the vehicular lamp including the plurality of light-emitting elements, and as a result, found that the size of the vehicular lamp in the related art can be further reduced.

SUMMARY OF THE INVENTION

The invention provides a technology for reducing the size of a vehicular lamp that includes a plurality of light-emitting elements.

An aspect of the invention relates to a vehicular lamp. The vehicular lamp includes a plurality of light-emitting elements arranged such that light-emitting surfaces of the light-emitting elements face toward a front of the vehicular lamp; and a projection lens having a plurality of projection regions that face the respective light-emitting elements, and project light source images of the respective light-emitting elements facing the projection regions, to the front of the vehicular lamp. A lamp rear surface of the projection lens has protruding portions provided in the respective projection regions, the protruding portions protruding toward the respective light-emitting elements facing the protruding portions. A lamp front surface of the projection lens is flatter than the lamp rear surface. According to the aspect, it is possible to reduce the size of the vehicular lamp that includes the plurality of light-emitting elements.

In the above-mentioned aspect, each of the protruding portions may have a protruding shape such that a projected image of the light source image has a shape that is more diffused in a first direction than in a second direction, with respect to a shape of the light source image, the first direction being perpendicular to a light-radiating direction of the projection region, and the second direction being perpendicular to the light-radiating direction and the first direction. In the above-mentioned aspect, each of the protruding portions may include a ridge portion. In the above-mentioned aspect, an extending direction of the ridge portion in at least one of the protruding portions may be inclined with respect to an extending direction of the ridge portion in another of the protruding portions. Further, in the above-mentioned aspect, each of the light-emitting surfaces may be substantially rectangular, and a longitudinal direction of the light-emitting surface may be parallel to an extending direction of the ridge portion in the corresponding protruding portion facing the light-emitting surface. According to the above-mentioned aspects, it is possible to form various light distribution patterns more easily.

According to the invention, it is possible to provide the technology for reducing the size of the vehicular lamp that includes the plurality of light-emitting elements.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
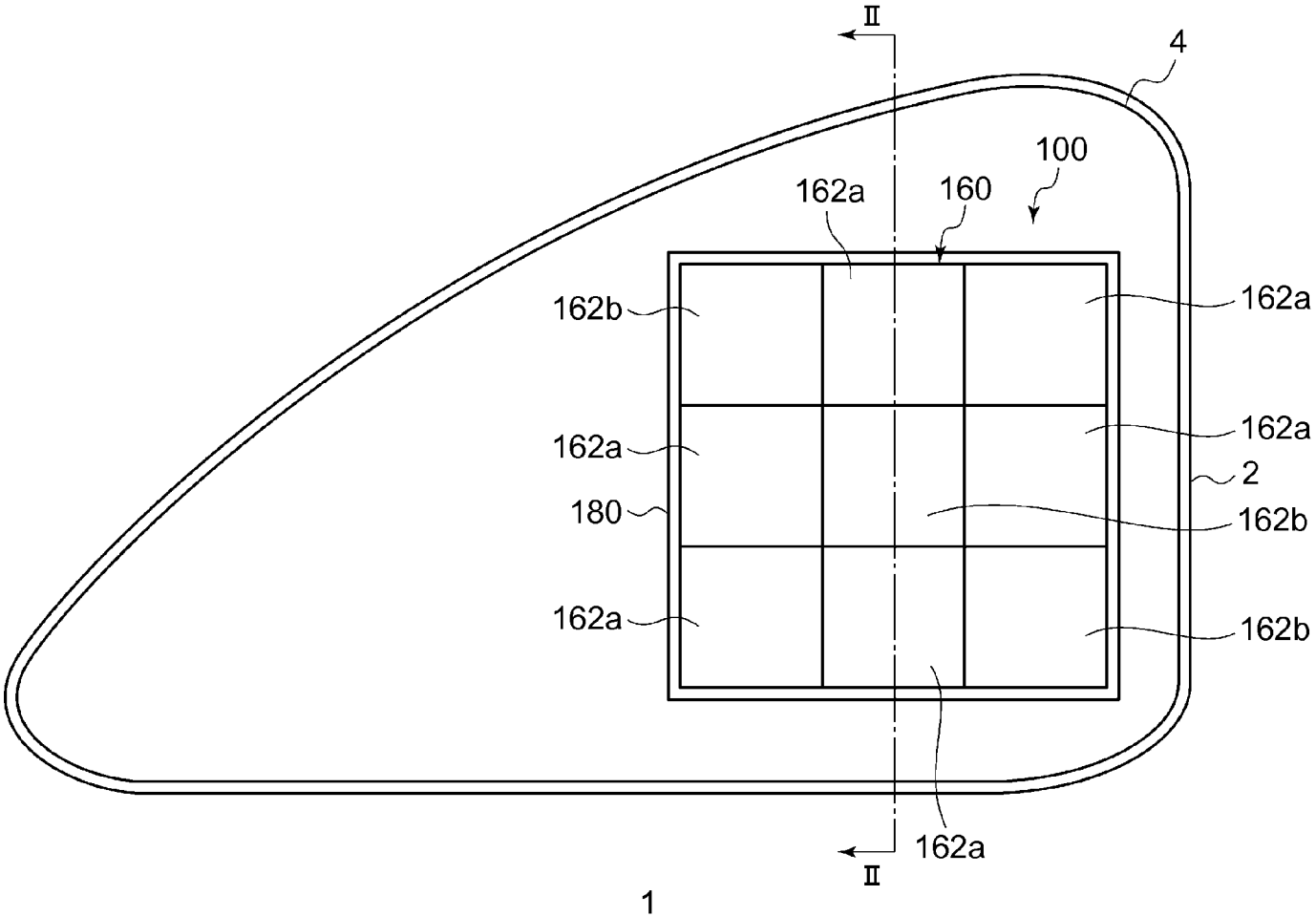
FIG. 1 is a front view showing a schematic structure of a vehicular lamp according to an embodiment of the invention.

Hereinafter, embodiments of the invention will be described with reference to the drawings. In the drawings, the same or equivalent constituent elements, members, and processes are denoted by the same reference numerals and signs, and duplicated descriptions thereof will be appropriately omitted. The embodiments are illustrative, and should not be construed as limiting the scope of the invention.

Figure 2:
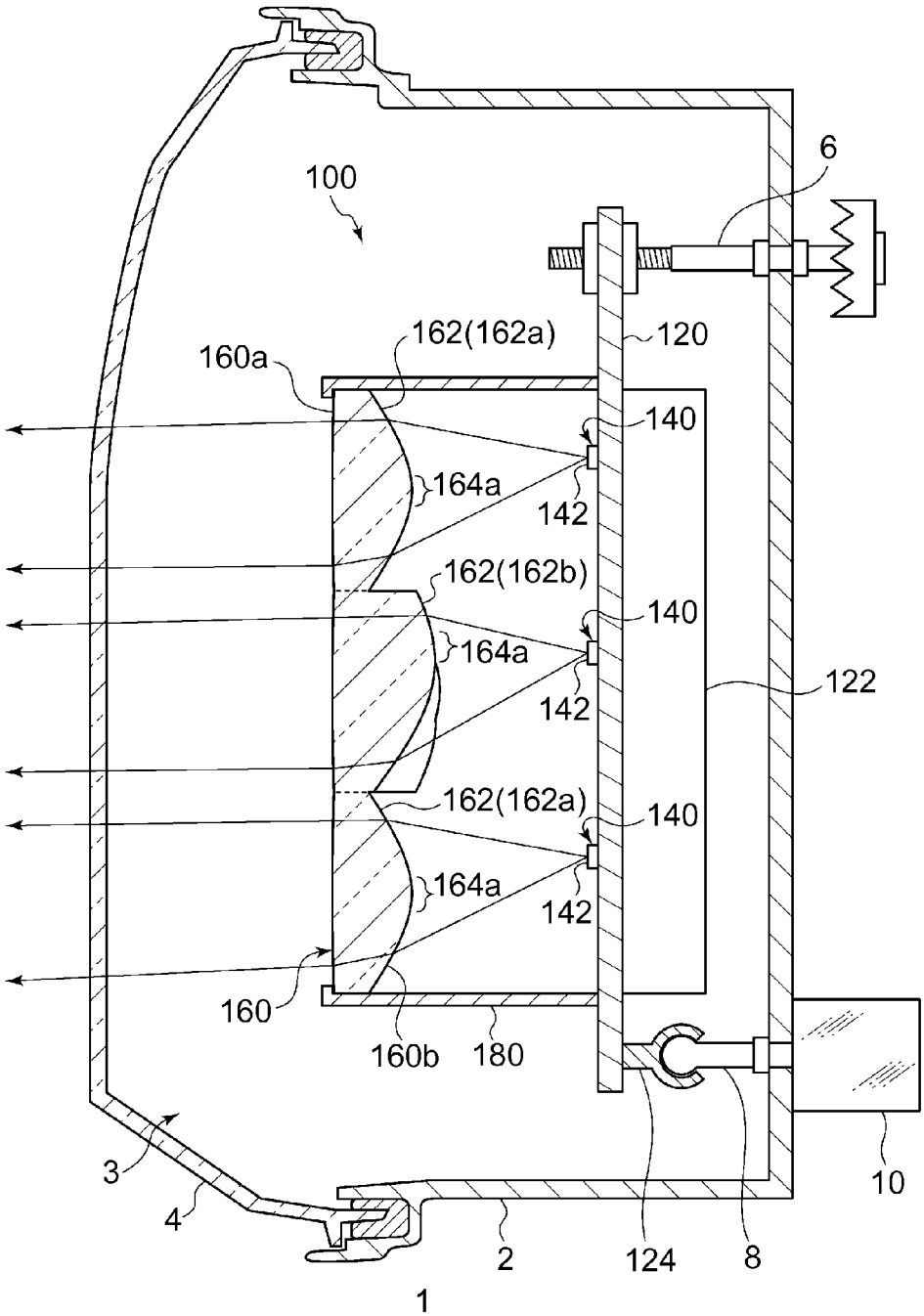
FIG. 2 is a vertical cross-sectional view showing the schematic structure of the vehicular lamp according to the embodiment of the invention.

FIG. 1 is a front view showing a schematic structure of a vehicular lamp according to an embodiment of the invention. FIG. 2 is a vertical cross-sectional view showing the schematic structure of the vehicular lamp according to the embodiment. FIG. 2 is a cross-sectional view taken along the line II-II in FIG. 1. The vehicular lamp 1 according to the embodiment is in a vehicular head lamp device including paired head lamp units respectively disposed at right and left sides in the front of a vehicle. The structures of the paired head lamp units are substantially the same except that the structures are symmetrical to each other. Thus, FIG. 1 shows the structure of the head lamp unit at the left side of the vehicle, as the vehicular lamp 1.

The vehicular lamp 1 includes a lamp body 2 that has an opening disposed in the front of the vehicle, and a translucent cover 4 that is fitted to cover the opening of the lamp body 2. The translucent cover 4 is formed of a resin having translucency, glass, or the like. A lamp unit 100 is housed in a lamp chamber 3 formed by the lamp body 2 and the translucent cover 4. The lamp unit 100 is a so-called projector type lamp unit. The lamp unit 100 includes a light source fitting portion 120, a plurality of light-emitting elements 140, a projection lens 160, and a lens holder 180.

The light source fitting portion 120 is a substantially flat plate. The main surfaces of the light source fitting portion 120 face toward the front and rear of the lamp, respectively. The plurality of light-emitting elements 140 are fitted to the main surface that faces the front of the lamp. A wiring pattern (not shown), to which the light-emitting elements 140 are electrically connected, is provided on the main surface that faces toward the front of the lamp. A radiation fin 122 is provided on the main surface that faces toward the rear of the lamp. Heat generated by the light-emitting elements 140 is transferred to the radiation fin 122 through the light source fitting portion 120.

Each of the light-emitting elements 140 is constituted by, for example, a semiconductor light-emitting element such as a light-emitting diode (LED). The light-emitting element 140 has a substantially rectangular light-emitting surface 142 (refer to FIG. 4 and FIG. 6). The light-emitting element 140 may have a structure in which the semiconductor light-emitting element is combined with a phosphor that converts the wavelength of the light from the semiconductor light-emitting element. The plurality of light-emitting elements 140 are arranged on an element fitting surface of the light source fitting portion 120 such that the light-emitting surfaces 142 face toward the front of the lamp, that is, toward the projection lens 160.

The projection lens 160 is disposed in front of the plurality of light-emitting elements 140 in the lamp. The projection lens 160 projects light source images of the light-emitting elements 140 to the front of the lamp. The projection lens 160 has a plurality of projection regions 162. The projection regions 162 face the respective light-emitting elements 140, and project the light source images of the respective light-emitting elements 140 facing the projection regions, to the front of the lamp. The light source image of each of the light-emitting elements 140 corresponds to the shape of the light-emitting surface 142 of the light-emitting element 140. The projection regions 162 of the projection lens 160 include first projection regions 162*a* and second projection regions 162*b*. The difference between the first projection region 162*a* and the second projection region 162*b* will be described in detail later. The projection lens 160 is constituted by one member in which the plurality of projection regions 162 are connected to each other (i.e., one member formed by performing processing on the surface of one lens such that the plurality of projection regions 162 are formed). The projection lens 160 may be formed by arranging individual small lenses corresponding to the projection regions 162.

In the embodiment, the nine projection regions 162 are arranged in a three by three matrix (3×3 matrix). The projection lens 160 has the six first projection regions 162*a* and the three second projection regions 162*b*. The second projection regions 162*b* are arranged obliquely. The number and arrangement of the projection regions 162 of the projection lens 160 are not particularly limited, and the ratio between the number of the first projection regions 162*a* and the number of the second projection regions 162*b* is not particularly limited. The projection regions 162 are arranged such that the projection regions 162 adjacent to each other have a common side. Thus, the distance between the projection regions 162 adjacent to each other can be reduced. Therefore, it is possible to reduce the size of the projection lens 160, and accordingly it is possible to reduce the size of the lamp unit 100. Each of the projection regions 162 is rectangular, more specifically, square when seen from the front of the lamp. This also leads to a reduction in the distance between the projection regions 162 adjacent to each other. Therefore, it is possible to reduce the size of the projection lens 160 and the size of the lamp unit 100.

A peripheral edge portion of the projection lens 160 is fixed to one end portion of the tubular lens holder 180, the one end portion being located at the front side of the lamp. The other end portion of the lens holder 180 is fixed to the light source fitting portion 120, the other end portion being located at the rear side of the lamp. Thus, the projection lens 160 is supported by the light source fitting portion 120 while the posture of the projection lens 160 is maintained such that the projection regions 162 face the respective light-emitting elements 140.

A screw hole is provided at a peripheral edge portion of the light source fitting portion 120. An aiming screw 6, which is rotatably supported by a wall surface of the lamp body 2, is screwed into the screw hole. A joint receiving portion 124 is provided on the light source fitting portion 120 to protrude toward the rear of the lamp. A leveling shaft 8, which extends toward the front of the lamp through the wall surface of the lamp body 2, is connected to the joint receiving portion 124. The leveling shaft 8 is connected to a leveling actuator 10. In the vehicular lamp 1, the optical axis of the lamp unit 100 can be adjusted in an up-down direction and a right-left direction, with the use of the aiming screw 6, the leveling shaft 8, and the leveling actuator 10. The structure for supporting the lamp unit 100 is not limited to the above-mentioned structure.

Figure 3:
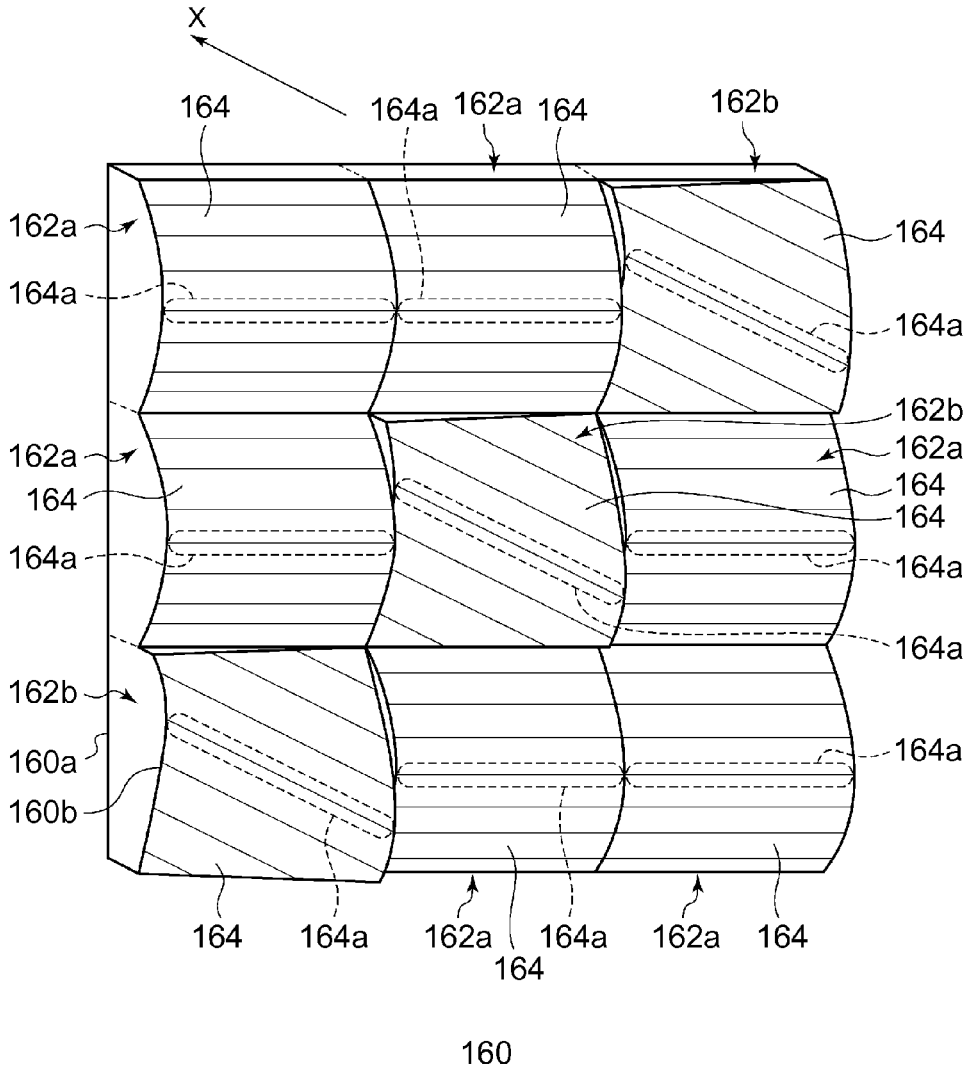
FIG. 3 is a perspective view showing a projection lens seen from the rear side of the lamp.
Figure 4:
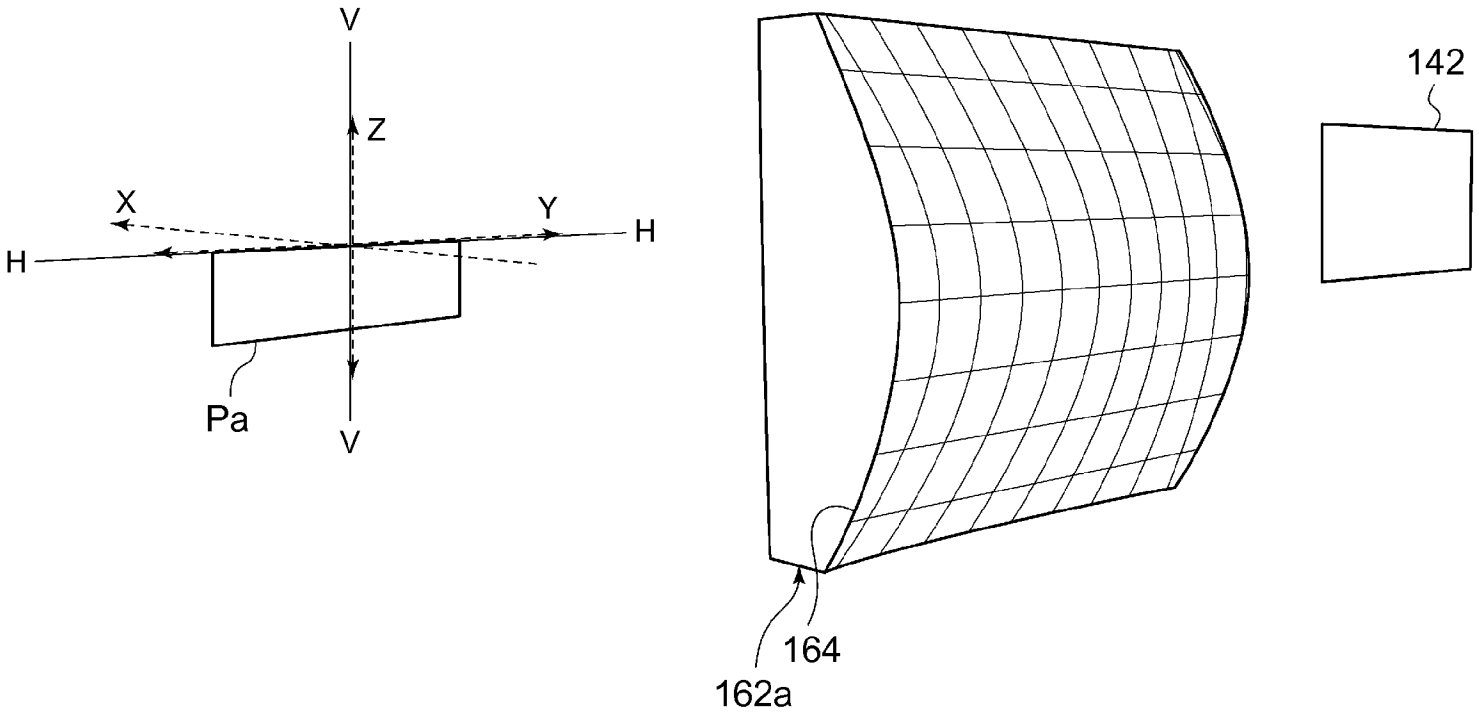
FIG. 4 is a schematic diagram showing a light-emitting surface, a first projection region, and a projected image projected by the first projection region.
Figure 5:
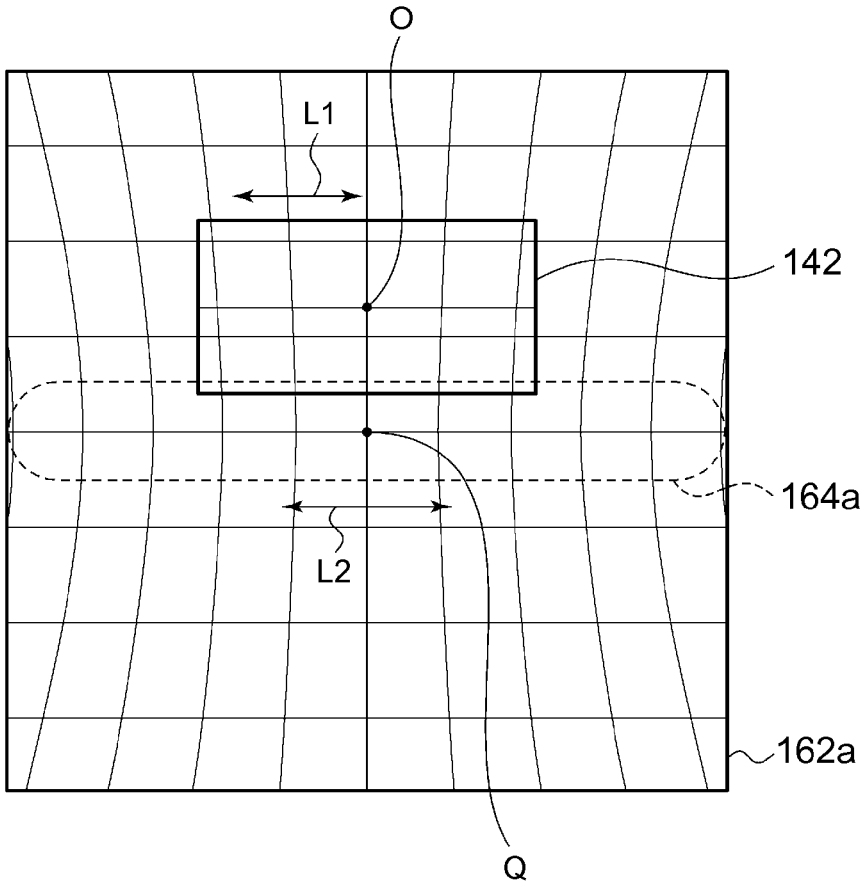
FIG. 5 is a schematic diagram showing a positional relation between the light-emitting surface and the first projection region.
Figure 6:
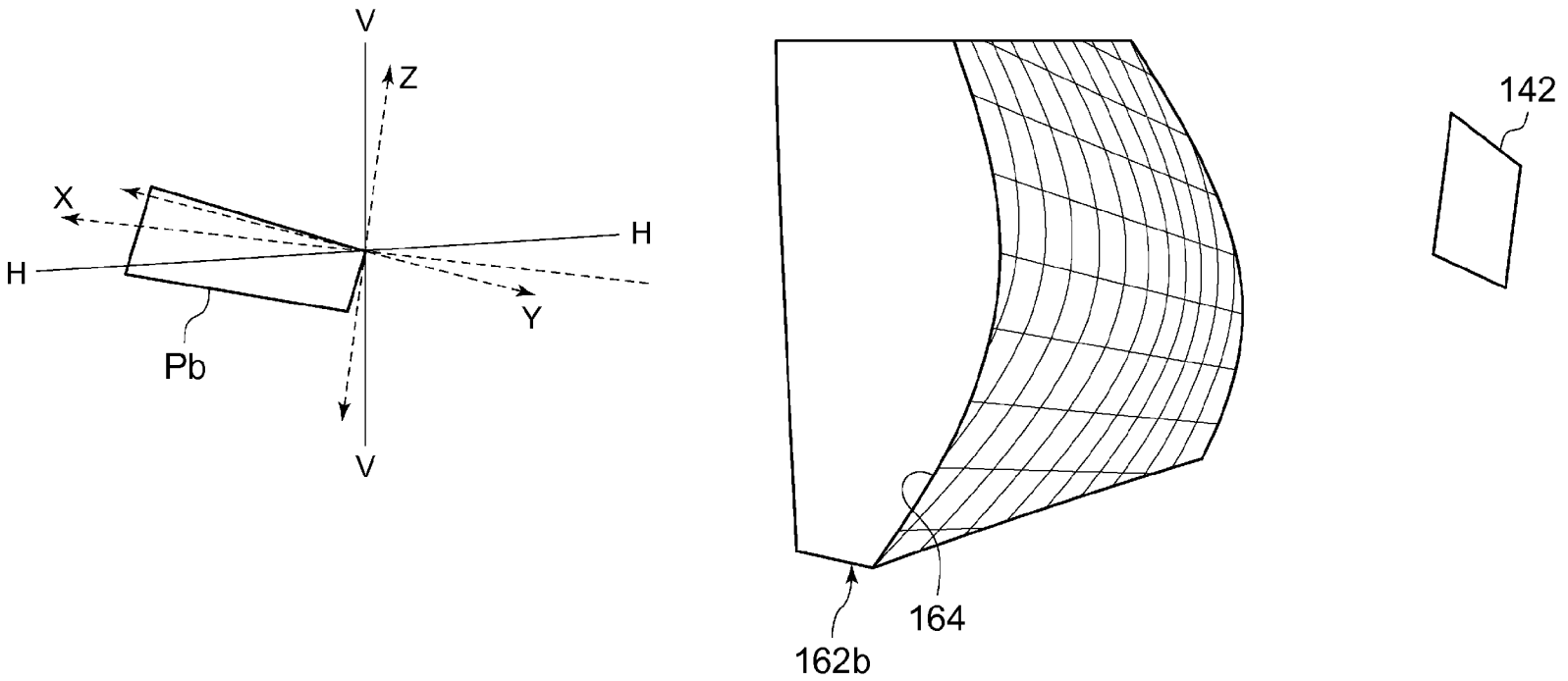
FIG. 6 is a schematic diagram showing the light-emitting surface, a second projection region, and a projected image projected by the second projection region.
Figure 7:
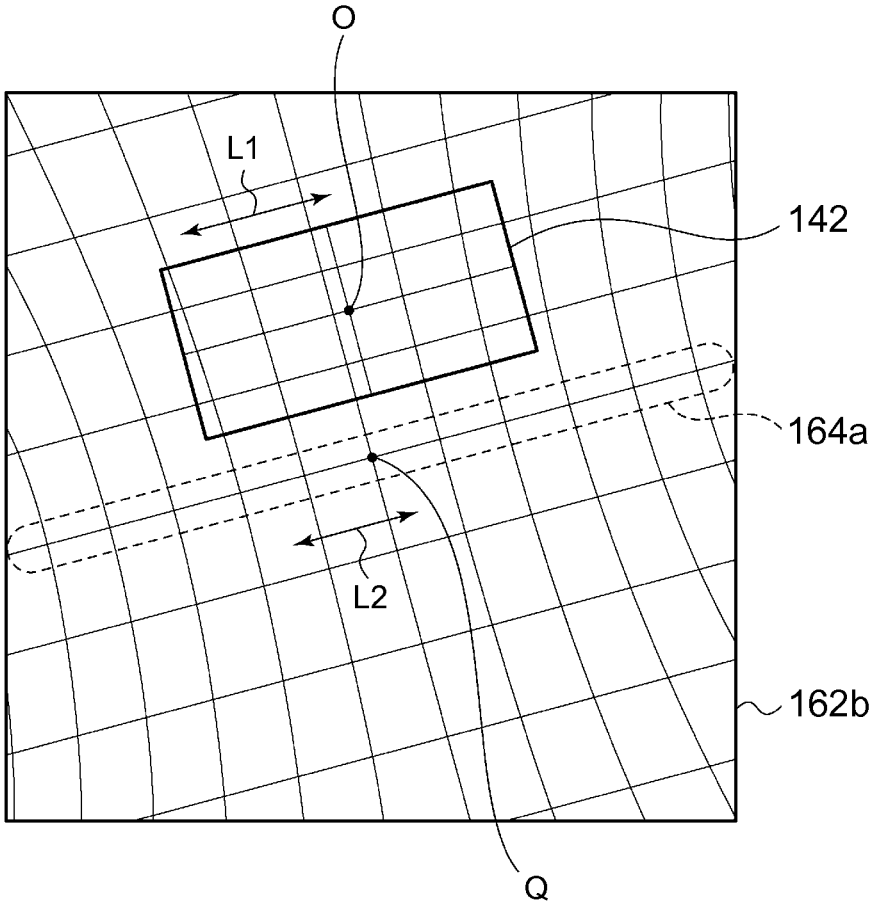
FIG. 7 is a schematic diagram showing a positional relation between the light-emitting surface and the second projection region.

Subsequently, the structure of the projection lens 160, and the arrangement of the projection lens 160 and the light-emitting elements 140, and the like will be described in detail. FIG. 3 is a perspective view showing the projection lens 160 seen from the rear of the lamp. FIG. 4 is a schematic diagram showing the light-emitting surface 142, the first projection region 162*a*, and a projected image Pa projected by the first projection region 162*a*. FIG. 5 is a schematic diagram showing a positional relation between the light-emitting surface 142 and the first projection region 162*a*. FIG. 6 is a schematic diagram showing the light-emitting surface 142, the second projection region 162*b*, and a projected image Pb projected by the second projection region 162*b*. FIG. 7 is a schematic diagram showing a positional relation between the light-emitting surface 142 and the second projection region 162*b*. Each of FIG. 4 and FIG. 6 shows the projection region and the light-emitting surface seen obliquely from the rear of the lamp. Each of FIG. 5 and FIG. 7 shows the projection region and the light-emitting surface seen from the front of the lamp. In each of FIG. 3 to FIG. 7, lines extending along the protruding shapes (i.e., lines indicating the protruding shapes) of portions provided in a lamp rear surface 160*b* are shown in order to facilitate understanding of the protruding shapes of the portions in the lamp rear surface 160*b*.

In the projection lens 160, protruding portions 164 are provided in the lamp rear surface 160*b*. The protruding portions 164 are provided in the respective projection regions 162. Each of the protruding portions 164 has a shape protruding toward the corresponding light-emitting element 140 that faces the protruding portion 164. In contrast, there is no protruding portion 164 in a lamp front surface 160*a* of the projection lens 160. Accordingly, the lamp front surface 160*a* is a flat surface, or has a slightly curved shape. Thus, the lamp front surface 160*a* is flatter than the lamp rear surface 160*b*.

Each of the protruding portions 164 has a protruding shape such that each of projected images Pa, Pb, which is formed by projecting the light source image to the front of the lamp, has a shape that is more diffused in a first direction Y than in a second direction Z, with respect to the shape of the light source image (that is, the shape of the light-emitting surface 142), the first direction Y (indicated by an arrow Y in each of FIG. 4 and FIG. 6) being perpendicular to a light-radiating direction X (indicated by an arrow X in each of FIG. 3, FIG. 4, and FIG. 6) of the projection region 162, and the second direction Z (indicated by an arrow Z in each of FIG. 4 and FIG. 6) being perpendicular to the light-radiating direction X and the first direction Y. The light-radiating direction X of the projection region 162 is, for example, a direction that is parallel to the optical axis of a sub unit configured by combining the projection region 162 and the corresponding light-emitting element 140 that faces the projection region 162. The optical axis of each sub unit is, for example, the axis that extends through the center O of the light-emitting surface 142 and the center of the projected image that is projected to the front of the lamp.

In the embodiment, each protruding portion 164 with a protruding shape includes a ridge portion 164*a*, that is, a crest-shaped portion or a ridge line portion such that the light source image is more enlarged in the first direction Y than in the second direction Z. The ridge portion 164*a* extends in parallel with the first direction Y. That is, the cross-section of the protruding portion 164, which is perpendicular to the first direction Y, has a protruding shape at any position in the first direction Y in at least a predetermined range in the first direction Y including the center of the projection region 162. The apexes of the protruding-shaped portions are continuous with each other to form the ridge portion 164*a*. The protruding portion 164 has a function similar to the function of a cylindrical lens, and thus, the protruding portion 164 can project the image of the light-emitting surface 142 to the front of the lamp such that the shape of the light-emitting surface 142 is more enlarged in the first direction Y than in the second direction Z.

The extending direction of the ridge portion 164*a* in at least one of the protruding portions 164 is inclined with respect to the extending direction of the ridge portion 164*a* in another of the protruding portions 164. In the embodiment, the extending direction of the ridge portions 164*a* in the second projection regions 162*b* is inclined with respect to the extending direction of the ridge portions 164*a* in the first projection regions 162*a*. For example, the extending direction of the ridge portions 164*a* in the first projection regions 162*a* is parallel to a horizontal direction. The extending direction of the ridge portions 164*a* in the second projection regions 162*b* is inclined by 15 degrees (15°) with respect to the horizontal direction.

As shown in FIG. 5 and FIG. 7, a longitudinal direction L1 of the light-emitting surface 142 with a substantially rectangular shape is parallel to an extending direction L2 of the ridge portion 164*a* in the corresponding protruding portion 164 that faces the light-emitting surface 142. Accordingly, the longitudinal direction L1 of the light-emitting surface 142 that faces the protruding portion 164 in the first projection region 162*a* extends in the horizontal direction. The longitudinal direction L1 of the light-emitting surface 142 that faces the protruding portion 164 in the second projection region 162*b* is inclined by 15 degrees (15°) with respect to the horizontal direction.

Further, each of the light-emitting elements 140 is disposed with respect to the corresponding projection region 162 such that the center O of the light-emitting surface 142 is offset from the center Q of the corresponding ridge portion 164*a* when the light-emitting element 140 and the corresponding projection region 162 are seen from the front of the lamp. In the first projection region 162*a*, the center O of the light-emitting surface 142 is offset upward in the vertical direction from the center Q of the ridge portion 164*a*. Similarly, in the second projection region 162*b*, the center O of the light-emitting surface 142 is offset upward in the vertical direction from the center Q of the ridge portion 164*a*. Since the center O of the light-emitting surface 142 is offset from the center Q of the corresponding protruding portion 164, a clear contrast boundary can be formed in the front of the lamp, using the sides of the light-emitting surface 142.

With the vehicular lamp 1 having the above-mentioned configuration, it is possible to form the projected image Pa extending in the horizontal direction as shown in FIG. 4, using the first projection region 162*a*. Further, it is possible to form the projected image Pb that is obliquely inclined as shown in FIG. 6, using the second projection region 162*b*. Each of the projected images Pa, Pb is an image formed by projecting the light source image such that the light source image is more diffused in the first direction Y than in the second direction Z by the projection region 162. Therefore, the ratio of the long side to the short side (the long side/the short side) in each of the projected images Pa, Pb is larger than the ratio of the long side to the short side (the long side/the short side) in the light-emitting surface 142.

With the vehicular lamp 1, it is possible to form light distribution patterns having a horizontal cut-off line extending in the horizontal direction and an oblique cut-off line that extends obliquely with respect to the horizontal direction, by overlapping the plurality of projected images Pa and the plurality of projected images Pb. Examples of the light distribution patterns include a low-beam distribution pattern. Since the low-beam distribution pattern is known, the detailed description thereof is omitted. The inclination angle of the ridge portion 164*a* in each second projection region 162*b* can be adjusted in accordance with the light distribution pattern that is formed.

In the vehicular lamp 1, the plurality of light-emitting elements 140 can be lit independently of each other. Therefore, it is possible to change the shape, the illuminance, and the like of the light distribution pattern that is formed.

As described above, the vehicular lamp 1 according to the embodiment includes the plurality of light-emitting elements 140, and the projection lens 160 that has the plurality of projection regions 162 that face the respective light-emitting elements 140, and project the light source images of the respective light-emitting elements 140 facing the projection regions 162, to the front of the lamp. The lamp rear surface 160*b* of the projection lens 160 has the protruding portions 164 that are provided in the respective projection regions 162, the protruding portions 164 protruding toward the respective light-emitting elements 140. The lamp front surface 160*a* of the projection lens 160 is flatter than the lamp rear surface 160*b* of the projection lens 160. Thus, it is possible to reduce the size of the vehicular lamp 1, as compared to the vehicular lamp in the related art in which the plurality of projection lenses are arranged at intervals (with spaces therebetween). Further, if the lengths of the lamp according to the embodiment in the up-down direction and the right-left direction are made equal to the lengths of the lamp in the related art in the up-down direction and the right-left direction, the length of the lamp in a front-rear direction can be reduced in the embodiment in which each of the projection regions 162 has the flat front surface and the protruding rear surface, as compared to the length of the lamp in the front-rear direction in the related art in which each of the aspherical lenses has the protruding front surface and the flat rear surface. This also leads to a reduction in the size of the vehicular lamp 1.

Each of the protruding portions 164 has a protruding shape such that each of the projected images Pa, Pb has a shape that is more diffused in the first direction Y than in the second direction Z, with respect to the shape of the light source image, the first direction Y being perpendicular to the light-radiating direction X of the projection region 162, and the second direction Z being perpendicular to the light-radiating direction X and the first direction Y. More specifically, each of the protruding portions 164 includes the ridge portion 164*a*. The extending direction L2 of the ridge portion 164*a* in at least one of the protruding portions 164 is inclined with respect to the extending direction L2 of the ridge portion 164*a* in another of the protruding portions 164. Further, each of the light-emitting surfaces 142 is substantially rectangular, and the longitudinal direction L1 of light-emitting surface 142 is parallel to the extending direction L2 of the ridge portion 164*a* in the corresponding protruding portion 164 that faces the light-emitting surface 142. Thus, it is possible to more easily form various light distribution patterns including the light distribution pattern diffused in the horizontal direction, and the light distribution pattern having the oblique cut-off line. Further, the various light distribution patterns can be realized without the need of providing an additional member such as a shade. Therefore, it is possible to avoid an increase in the size of the vehicular lamp.

The projection lens 160 has the plurality of projection regions 162. The light-emitting elements 140 that correspond to the respective projection regions 162 are lit independently of each other. Further, the lamp front surface 160*a* is a substantially flat surface. Therefore, the design (appearance) of the vehicular lamp 1 is improved. Further, as described above, the oblique cut-off line is formed simply by inclining the ridge portions 164*a* and the light-emitting surfaces 142. Therefore, it is possible to form the light distribution pattern having the oblique cut-off line, without changing the installation space for the projection lens 160, while maintaining the design (appearance) of the vehicular lamp 1.

The invention is not limited to the above-mentioned embodiments, and various modifications, such as design modifications, may be added to the above-mentioned embodiments based on the knowledge of persons skilled in the art. The modified embodiments, to which the modifications are added, are also included in the scope of the invention. Embodiments obtained by combining the above-mentioned embodiments with the modified embodiments have effects of the above-mentioned embodiments and the modified embodiments.

What is claimed is:

1. A vehicular lamp comprising:

a plurality of light-emitting elements arranged such that light-emitting surfaces of the light-emitting elements face toward a front of the vehicular lamp; and a projection lens having a plurality of projection regions that face the respective light-emitting elements, and project light source images of the respective light-emitting elements facing the projection regions, to the front of the vehicular lamp, wherein:

a lamp rear surface of the projection lens has protruding portions provided in the respective projection regions, the protruding portions protruding toward the respective light-emitting elements facing the protruding portions; and in each of the respective projection regions, a lamp front surface of the projection region is flatter than the lamp rear surface of the projection region;

wherein each of the protruding portions includes a ridge portion.

2. The vehicular lamp according to claim 1, wherein each of the protruding portions has a protruding shape such that a projected image of the light source image has a shape that is more diffused in a first direction than in a second direction, with respect to a shape of the light source image, the first direction being perpendicular to a light-radiating direction of the projection region, and the second direction being perpendicular to the light-radiating direction and the first direction.

3. The vehicular lamp according to claim 1, wherein the projection regions are arranged such that the projection regions adjacent to each other have a common side.

4. The vehicular lamp according to claim 1, wherein an extending direction of the ridge portion in at least one of the protruding portions is inclined with respect to an extending direction of the ridge portion in another of the protruding portions.

5. The vehicular lamp according to claim 1, wherein each of the light-emitting surfaces is substantially rectangular, and a longitudinal direction of the light-emitting surface is parallel to an extending direction of the ridge portion in the corresponding protruding portion facing the light-emitting surface.

6. The vehicular lamp according to claim 1, wherein each of the light-emitting elements is disposed with respect to the corresponding projection region such that a center of the light-emitting surface is offset from a center of the corresponding ridge portion when the light-emitting element and the corresponding projection region are seen from the front of the vehicular lamp.

* * * * *